US005118313A

United States Patent [19]

Delalle

[11] Patent Number: 5,118,313

[45] Date of Patent: Jun. 2, 1992

[54] ELECTRICAL TERMINAL

[75] Inventor: Jacques Delalle, Triel-sur-Siene, France

[73] Assignee: Raychem SA, Cergy-Saint Christophe, France

[21] Appl. No.: 635,581

[22] PCT Filed: Jul. 5, 1989

[86] PCT No.: PCT/GB89/00759

§ 371 Date: Mar. 5, 1991

§ 102(e) Date: Mar. 5, 1991

[87] PCT Pub. No.: WO90/00819

PCT Pub. Date: Jan. 25, 1990

[30] Foreign Application Priority Data

Jul. 8, 1988 [GB] United Kingdom ..... 8816291

[51] Int. Cl.[5] ..... H01R 4/18

[52] U.S. Cl. ..... 439/730; 439/936

[58] Field of Search ..... 439/730, 874, 875, 877, 439/879, 881, 882, 936, 932

[56] References Cited

U.S. PATENT DOCUMENTS

| | | | |
|---|---|---|---|
| 23,688 | 7/1953 | Watts | 439/730 |
| 2,715,716 | 8/1955 | Woolley, Jr. | 439/730 |
| 2,789,278 | 4/1957 | Soreng | 439/877 |
| 2,932,685 | 4/1960 | Raila et al. | 439/523 |
| 3,634,817 | 1/1972 | Wise | 439/730 |
| 3,963,295 | 6/1976 | Askman et al. | 439/730 |

FOREIGN PATENT DOCUMENTS

| | | |
|---|---|---|
| 0006297 | 1/1980 | European Pat. Off. . |
| 203686 | 12/1986 | European Pat. Off. . |
| 203751 | 12/1986 | European Pat. Off. . |
| 0260553 | 3/1988 | European Pat. Off. . |
| 1935976 | 2/1971 | Fed. Rep. of Germany . |
| 1077746 | 2/1967 | United Kingdom . |

*Primary Examiner*—Larry I. Schwartz
*Assistant Examiner*—Hien D. Vu
*Attorney, Agent, or Firm*—Edith A. Rice; Herbert G. Burkard

[57] ABSTRACT

A terminal for an electrical wire comprieses a terminal portion (1) for forming a disconnectable electrical connection to a corresponding terminal, a crimp portion (3) for forming a crimp to the conductor of the electrical wire, a neck (4) that connects the terminal to the crimp portion, and a plastics sleeve (7) located over the neck and crimp portion and extending beyond the end of the crimp portion. The neck (4) and the part of the sleeve (7) located over the neck together retain a quantity of sealant e.g. hot-melt adhesive 6 for preventing or reducing passage of moisture from the terminal portion to the crimp portion.

9 Claims, 2 Drawing Sheets

ELECTRICAL TERMINAL

SUMMARY OF THE INVENTION

This invention relates to electrical terminals and especially to small electrical terminals for primary wires that may be employed for example in general electronic equipment, in automotive equipment and the like.

Such terminals may be manufactured in many forms, for example as ring terminals, or fork terminals in which the terminal is in the form of a punched annulus or "C" shaped element, as pins or tags, or as so-called "slip-on" terminals in which the side edges of a small flat substantially rectangular piece of metal are curled toward the centre of the piece so that the edges and the central part together form bearing surfaces for a corresponding connection tag. They are usually provided with a crimp portion that can be crimped onto the conductor of a wire.

The object of the present invention is to provide a simple form of electrical terminal for connection to primary wires which can prevent or reduce the likelihood of moisture ingress to the cable conductor.

Accordingly, the present invention provides a terminal for an electrical wire, which comprises a terminal portion for forming a disconnectable electrical connection to a corresponding terminal, a crimp portion for forming a crimp to the conductor of the electrical wire, a neck that connects the terminal portion to the crimp portion, and a plastics sleeve that is located over the neck and crimp portion and extends beyond the end of the crimp portion, the neck and the part of the sleeve located over the neck together retaining a quantity of sealant for preventing passage of moisture from the terminal portion to the crimp portion.

The neck is preferably at least 2.0 mm long, preferably at least 2.5 mm long and usually up to 4 mm long e.g. from 2.5 to 3.5 mm long, although in some forms of terminal the neck is even longer, e.g. from 5 to 10 mm long and especially from 7 to 8 mm long. The increase in length of the neck enables a quantity of sealant to be provided between the neck and the plastics sleeve for sealing the neck portion of the terminal against passage of moisture to the wire. Usually the neck will have a substantially "U" or "C" shaped cross-section which has been formed by stamping, in order to increase the rigidity of the neck against any bending forces. In this case the sealant will be located in the interior of the neck and will occupy substantially the entire space between the neck and the plastics sleeve so as to prevent, or at least greatly reduce, any passage of moisture along the neck.

The sealant is preferably a hot-melt adhesive, and especially one formed from an olefin homo- or copolymer with other olefins, or ethylenically unsaturated monomers, e.g. high, medium or low density polyethylene and ethylene copolymers with alpha olefins especially $C_3$ to $C_8$ alpha olefins, vinyl acetate or ethyl acrylate; polyamides, polyesters, halogenated polymers and the like. Preferred polyamides include those polyamides having an average at least 15 carbon atoms between amide linkages for example those based on dimer acids and/or dimer diamines. Examples of such adhesives are given in U.S. Pat. Nos. 4,018,733 to Lopez et al and 4,181,775 to Corke et al. Preferred polyesters include polybutylene terephthalate and butylene ether butylene terephthalate block copolymers.

The plastics sleeve may be formed for example from an olefin homo- or copolymer e.g. high, medium or low density polyethylene or ethylene copolymers with $C_3$ to $C_8$ alpha olefins, vinyl acetate or ethyl acrylate, polyamides e.g. nylon 6, nylon 6,6, nylon 11 or nylon 12, polyesters, e.g. polybutylene terephthalate or butylene terephthalate butylene or butylene terephthalate butylene ether copolymers, fluoropolymers such as polyvinylidene fluoride or aromatic polymers e.g. polysulphones, polyetherimides, polyetherketones and the like. Preferably the polymer will be relatively strong having an $M_{100}$ value above the melting point of the plastics material, e.g. at 200° C. in the case of nylon 11, of at least 2.1, and especially at least 5 kgf $cm^{-2}$. For this reason the preferred plastics materials are those based on nylon 11, nylon 12 and high density polyethylene.

In some forms of terminal according to the invention the plastics sleeve may be dimensionally heat-recoverable. Heat-recoverable articles are articles the dimensional configuration of which may be made substantially to change when subjected to heat treatment. Usually these articles recover, on heating, towards an original shape from which they have previously been deformed but the term "heat-recoverable", as used herein, also includes an article which, on heating, adopts a new configuration, even if it has not been previously deformed. In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimension-ally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

The plastics material forming the sleeve may be cross-linked (whether or not it is heat-recoverable) for example by exposure to high energy radiation such as an electron beam or gamma-rays. Radiation dosages in the range 20 to 800 kGy, preferably 20 to 500 kGy, e.g. 20 to 200 kGy and particularly 40 to 120 kGy are in general appropriate depending on the characteristics of the polymer in question. For the purposes of promoting cross-linking during irradiation, preferably from 0.2 to 15 weight per cent of a crosslinking promotor such as a poly-functional vinyl or allyl compound, for example, triallyl cyanurate, triallyl isocyanurate (TAIC), methylene bis acrylamide, metaphenylene diamine bis maleimide or other crosslinking agents, for example as described in U.S. Pat. Nos. 4,121,001 and 4,176,027, are incorporated into the composition prior to irradiation.

The plastics material may include additional additives, for example reinforcing or non-reinforcing fillers, stabilisers such as ultra-violet stabilisers, antioxidants, acid acceptors and anti-hydrolysis stabilisers, pigments, processing aids such as plasticizers, halogenated or non-halogenated flame retardants, fungicides and the like.

Where the plastics sleeve is heat-recoverable it may simply be recovered about the neck, preferably both the neck and the crimp, portions of the terminal, after a quantity of hot-melt adhesive has previously been located in the neck of the terminal. The portion of the sleeve that extends beyond the end of the crimp portion and which is therefore located around any wire that has been terminated by the device, may be recovered onto the wire or may be left in its larger diameter unrecovered state (or part of the length thereof may be recovered onto the wire). Whether the sleeve is recovered or not will depend on the size of the terminal, gauge of the wire and the thickness and the material of the sleeve, in order to optimise strain relief against bending of the wire. In some instances the plastics sleeve will end at the neck region of the terminal portion, while in other cases the sleeve will extend over the terminal portion in the form of a skirt. In either case the sleeve may be compressed, e.g. by being passed through the nip of a pair of rollers, in order to compress the adhesive and form a secure seal.

In some instances the forces exerted on the crimp by the crimping tool may cause the adhesive to crack or cause paths for moisture penetration between the adhesive and the terminal neck or sleeve. Any such crack or moisture penetration path may be removed simply by directing a hot-air gun onto the neck portion of the terminal to melt or soften the adhesive briefly. This operation may be performed as part of the heating procedure for a heat-shrinkable sleeve.

BRIEF DESCRIPTION OF THE DRAWINGS

Two forms of article in accordance with the present invention will now be described by way of example with reference to the accompanying drawings in which.

DESCRIPTION OF PREFERRED EMBODIMENTS

Figure 1:
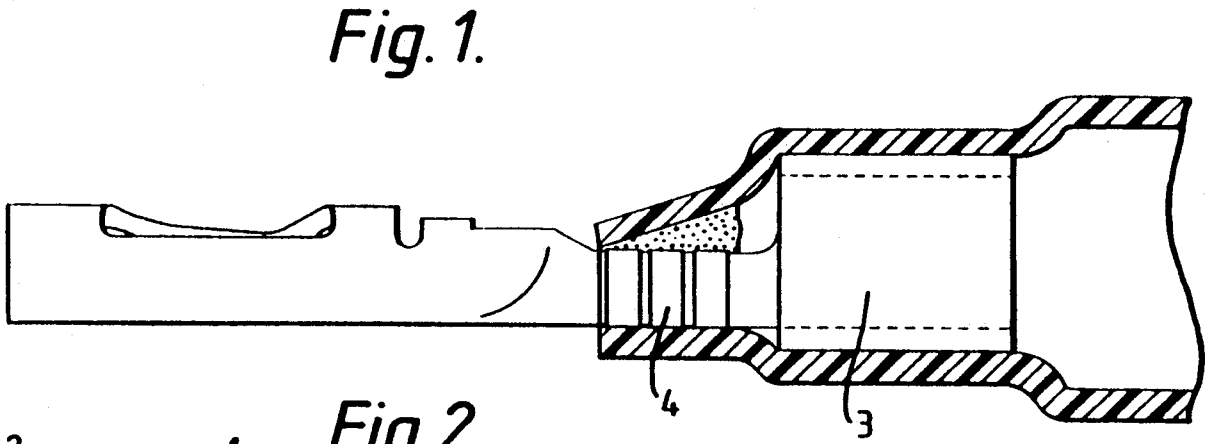
FIG. 1 is a side view of a terminal according the invention.
Figure 2:
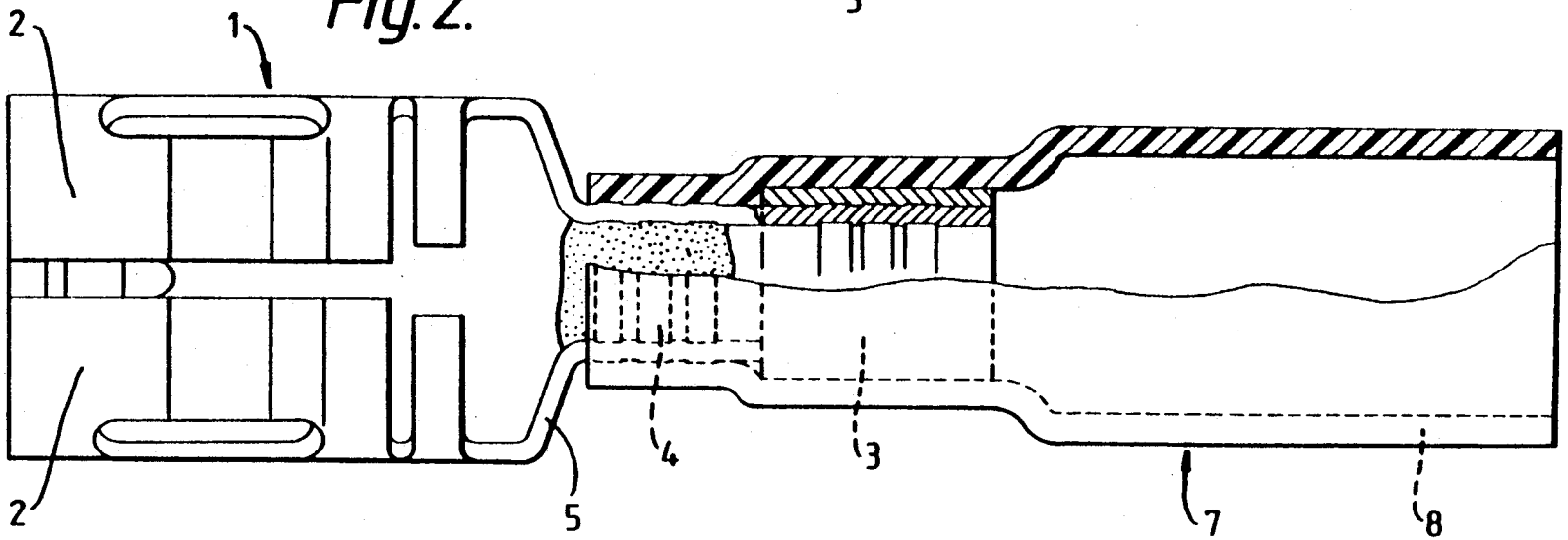
FIG. 2 is a partially cut-away top view of the terminal shown in FIG. 1.
Figure 3:
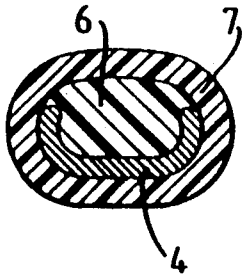
FIG. 3 is a cross-sectional elevation taken along the line II—II of FIG. 2.

Referring to the accompanying drawings, FIGS. 1 to 3 show a terminal for forming a detachable electrical connection between a pair of wires comprising a terminal portion 1 formed by folding the side edges 2 of a generally rectangular stamped metal sheet back toward the centre of the sheet. The terminal portion is joined to a crimp portion 3 by means of a neck 4. The neck portion is about 6 mm long between the shoulder 5 of the terminal portion and the near end of the crimp portion 3. The neck is substantially "C" shaped in cross-section and contains a quantity of hot melt adhesive 6, e.g. a polyamide or ethylene/vinyl acetate adhesive.

A heat-shrinkable sleeve 7 formed from crosslinked nylon 11 or nylon 12 has been recovered over the neck 4 and crimp portion 3 to provide electrical insulation and a barrier to ingress of moisture. The sleeve extends beyond the end of the crimp 3 to form a skirt 8 of larger diameter. During recovery of the sleeve about the neck 4 and crimp 3 the hot-melt adhesive 6 was caused to melt and seal the neck of the terminal against moisture penetration.

In order to terminate a wire, the end of the wire is stripped of insulation and is inserted into the crimp portion 3 of the terminal. The crimp portion is crimped onto the inserted wire conductor and the skirt 8 of the heat-shrinkable sleeve 7 is recovered onto the wire, heat being applied at the same time to the neck 4 of the terminal in order to cause the adhesive 6 to reseal any moisture paths formed when the wire was crimped.

Figure 4:
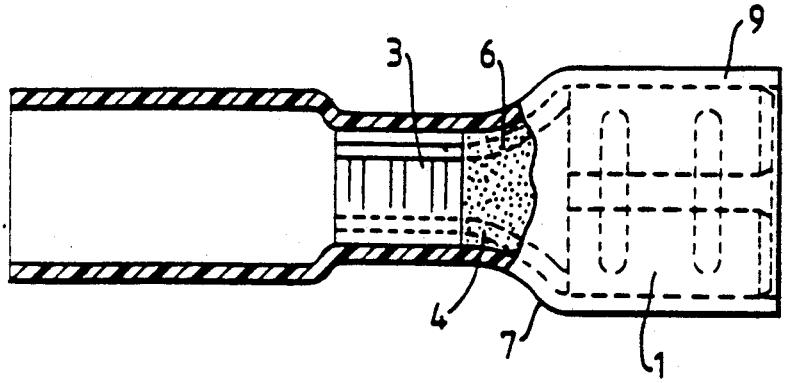
FIG. 4 is a top view of a second form of device according to the invention.
Figure 5:
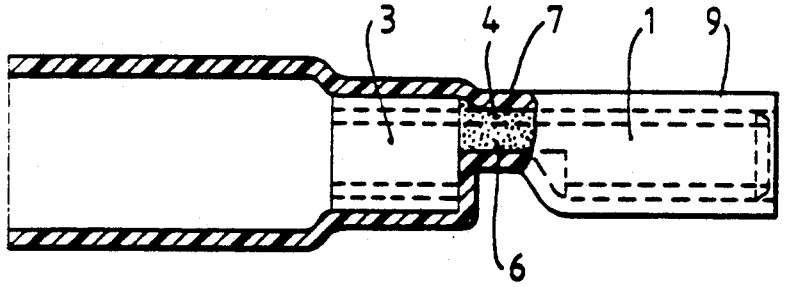
FIG. 5 is a side view of the device of FIG. 4.

FIGS. 4 and 5 show a second form of terminal in which the sleeve 7 extends over the terminal portion 1 in the form of a skirt 9 which may end at the end of the terminal portion 1 but which may be shorter, to expose part of the terminal, or which may extend beyond the end of the terminal portion 1.

During manufacture of the device a pellet of the adhesive 6 is inserted into the neck of the terminal before the heat shrinkable sleeve 7 is slipped over the terminal portion 1. The sleeve 7 (or at least that part located over the terminal portion 1, neck 4 and crimp 3) is then heated to cause it partially to recover while at the same time it is compressed to form a waist portion 9 over the terminal neck 4, this operation causing the adhesive 6 to melt and seal that part of the device against moisture penetration.

I claim:

1. A terminal for an electrical wire, which comprises a terminal portion that is formed from a stamped metal sheet for forming a disconnectable electrical connection to a corresponding terminal, a crimp potion for forming a crimp to the conductor of the electrical wire, a neck that connect the terminal portion to the crimp portion, and a plastic sleeve that is located over the neck and crimp portion and extends beyond an end of the crimp portion, the neck being substantially "U" or "C" shaped in cross-section and having an interior which together with the part of the sleeve located over the neck retains a quantity of sealant for preventing passage of moisture from the terminal portion to the crimp portion.

2. A terminal as claimed in claim 1, wherein the neck has a length of at least 2.0 mm.

3. A terminal as claimed in claim 1 or claim 2, wherein the neck has a length of not more than 4.0 mm.

4. A terminal as claimed in claim 1 or claim 2 wherein the interior of the neck contains the sealant.

5. A terminal as claimed in claim 1 or claim 2, wherein the terminal portion is in the form of a slip-on terminal, a ring terminal, a fork terminal, a pin or a tag.

6. A terminal as claimed in claim 1 or claim 2, wherein the plastics sleeve comprises a polyamide or polyolefin.

7. A terminal as claimed in claim 6, wherein the plastics sleeve comprises nylon 11 or nylon 12.

8. A terminal as claimed in claim 1 or claim 2, wherein the plastics sleeve is dimensionally heat-recoverable.

9. A terminal as claimed in claim 1 or claim 2, wherein the part of the sleeve that extends beyond the end of the crimp portion provides a skirt for strain relief for a wire connected to the terminal.

* * * * *